US008446290B2

(12) United States Patent
Affolter et al.

(10) Patent No.: US 8,446,290 B2
(45) **Date of Patent: *May 21, 2013**

(54) SELF CONTAINED DEVICE FOR DISPLAYING ELECTRONIC INFORMATION

(75) Inventors: Allen Affolter, Indiana, PA (US); Titus Mathews, Calgary (CA)

(73) Assignee: ATG Designworks, LLC, Indiana, PA (US)

( * ) Notice: Subject to any disclaimer, the term of this patent is extended or adjusted under 35 U.S.C. 154(b) by 1107 days.

This patent is subject to a terminal disclaimer.

(21) Appl. No.: 12/381,304

(22) Filed: Mar. 10, 2009

(65) Prior Publication Data

US 2009/0207155 A1 Aug. 20, 2009

Related U.S. Application Data

(63) Continuation of application No. 12/211,905, filed on Sep. 17, 2008, now abandoned, which is a continuation of application No. 11/774,670, filed on Jul. 9, 2007, now Pat. No. 7,436,318, which is a continuation-in-part of application No. 10/828,406, filed on Apr. 19, 2004, now Pat. No. 7,242,315.

(51) Int. Cl.
*G08B 5/22* (2006.01)

(52) U.S. Cl.
USPC ..... 340/815.83; 434/317; 345/169; 345/204

(58) Field of Classification Search ..... 340/815.4, 340/815.45, 815.83, 540, 691.6, 573.1, 541, 340/573.2; 345/1.3, 30, 87, 156, 169, 204; 222/40, 222/39, 52, 78; 434/317, 308, 309
See application file for complete search history.

(56) References Cited

U.S. PATENT DOCUMENTS

| | | | | |
|---|---|---|---|---|
| 5,657,004 | A * | 8/1997 | Whittaker et al. | 340/815.45 |
| 6,573,880 | B1 * | 6/2003 | Simoni et al. | 345/87 |
| 6,717,522 | B1 * | 4/2004 | Nagatomo et al. | 340/815.4 |
| 7,009,523 | B2 * | 3/2006 | Blum et al. | 340/815.4 |
| 7,242,315 | B2 * | 7/2007 | Affolter et al. | 340/815.83 |

* cited by examiner

*Primary Examiner* — Anh V La
(74) *Attorney, Agent, or Firm* — Whiteford, Taylor & Preston LLP

(57) ABSTRACT

A thin flexible electronic display includes a flexible membrane, control circuitry, and self-contained power source, which may be a thin flexible battery. A display may be affixed to an associated device for use in displaying dynamic information or video.

65 Claims, 8 Drawing Sheets

SELF CONTAINED DEVICE FOR DISPLAYING ELECTRONIC INFORMATION

CROSS REFERENCE TO RELATED APPLICATIONS

This application is a continuation of, and claims priority to, U.S. patent application Ser. No. 12/211,905, filed Sep. 17, 2008 now abandoned, which application is a continuation of U.S. patent application Ser. No. 11/774,670, filed Jul. 9, 2007, and now U.S. Pat. No. 7,436,318, issued Oct. 14, 2008, which application is a continuation-in-part of U.S. patent application Ser. No. 10/828,406, filed Apr. 19, 2004, and now U.S. Pat. No. 7,242,315, issued Jul. 10, 2007.

I. BACKGROUND OF THE INVENTION

A. Field of Invention

This invention pertains to the art of methods and apparatuses of displaying information on a thin, flexible display and more specifically to displaying dynamic video in a magazine or periodical.

B. Description of the Related Art

It is known in the art to publish various types of documents such as periodicals, magazines, manuals and the like. Typically, such published documents are printed on flexible pages, which may be comprised of varying paper thicknesses or weights. As is well known in the art, frequently pictures and/or words are arranged on the individual pages of the published document, which may be bound together at a binding. In any case, such published documents are widely known and publicly available for purchase on numerous topics. In a similar manner, instruction manuals are frequently printed with images and/or verbiage for use in guiding a user, for example, through a set up procedure for a purchased item. In all of these printed documents, the data displayed thereon is purely static in that the images do not move but rather are displayed in the typical form as is well known in the art. There are limitations of the static information printed on a flexible page to convey information to the user or viewer. Therefore, it would be useful to convey dynamic information in the form of video and/or audio signals to the user viewing a periodical, magazine, or instruction manual.

The present invention provides methods and apparatuses for displaying such dynamic information in a flexible periodical or manual.

II. SUMMARY OF THE INVENTION

One aspect of the present invention includes a method for displaying information in a magazine, the steps comprising: providing one or more adjacent flexible pages bound together at a binding; providing a flexible self-contained information displaying means, the self-contained information displaying means including: an electronic display membrane, control circuitry operatively communicated to the electronic display membrane for use in electronically displaying information on the electronic display membrane, and, at least a first power cell operatively communicated to the control circuitry and display membrane for use in supplying power to the control circuitry; affixing the electronic display membrane to one of the flexible pages; and, automatically displaying at least a first electronically preprogrammed information message on the electronic display membrane.

Another aspect of the present invention includes a step of providing a flexible self-contained information displaying means, the self-contained information displaying means further comprising: a sensor for use in determining the proximity of a flexible page; and, wherein before the step of automatically displaying at least a first electronically preprogrammed information message on the electronic display membrane, the step further comprising: sensing the turning of a flexible page adjacent to the electronic display membrane.

Another aspect of the present invention includes a step of: affixing the control circuitry to the binding.

Another aspect of the present invention includes a step of: affixing the control circuitry to one of the flexible pages.

Another aspect of the present invention includes a step of providing a flexible self-contained information displaying means further includes: electronic information storage means.

Another aspect of the present invention includes a step of: selectively communicating the electronic information storage means to the control circuitry.

Another aspect of the present invention includes a step of selectively communicating the electronic information storage means to the control circuitry, the step further comprising: preprogramming the electronic information storage means.

Another aspect of the present invention includes a step of providing a flexible self-contained information displaying means, the self-contained information displaying means further comprising: an electronic data receiving port operatively communicated to the control circuitry; and, further comprising the step of: selectively operatively communicating the electronic information storage means to the control circuitry, and, programming the electronic information storage means via electronic data receiving port.

Another aspect of the present invention includes a magazine, comprising: at least first and second flexible pages bound together at a binding; a thin electronic display membrane fixedly attached to the first flexible page; electronic control circuitry operatively communicated to the electronic display membrane; at least a first power cell operatively communicated to the electronic control circuitry for use in supplying power to the electronic control circuitry.

Another aspect of the present invention includes a magazine, further comprising: electronic information storage means selectively removable with respect to the electronic control circuitry.

Another aspect of the present invention includes a magazine, further comprising: user interface means operatively communicated to the electronic control circuitry.

Another aspect of the present invention includes a magazine, further comprising: sensor means for use in determining the proximity of the at least a first flexible page with respect to the at least a second flexible page.

Another aspect of the present invention includes a magazine, further comprising: audio transmitting means operatively communicated to the electronic control circuitry.

Another aspect of the present invention includes a magazine, wherein the audio transmitting means is a speaker.

The present invention utilizes an apparatus and claimed methods for a flexible display membrane, and affixing the flexible membrane to various items. In one embodiment, the display includes a membrane which is flexible and which may be affixed to the page as mentioned. Subsequently, the display may include control circuitry also fashioned in a flexible manner and a power source again which may be thin and flexible all of which may comprise the basic flexible display. Additional items may be included in the display including the communications port sensor means and audio transmitting means. The display may be affixed to the page of a periodical as mentioned for use in displaying dynamic information or video. Preprogrammed video messages may be stored in the memory of the control circuitry or display on the flexible membrane.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein:

FIG. 1 is a plan view of the flexible electronic display;

FIG. 1*a* is a side view of the flexible electronic display;

FIG. 2 is a plan view of an alternate embodiment of the flexible electronic display;

FIG. 2*a* is a side view of an alternate embodiment of the flexible electronic display;

Figure 4:
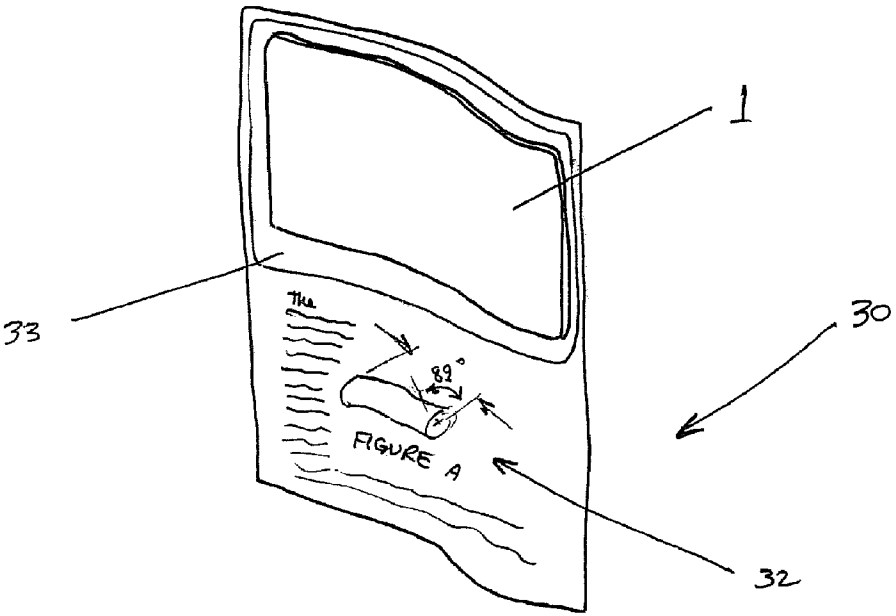
FIG. 4 is a perspective view of a flexible page including the flexible electronic display.
Figure 4A:
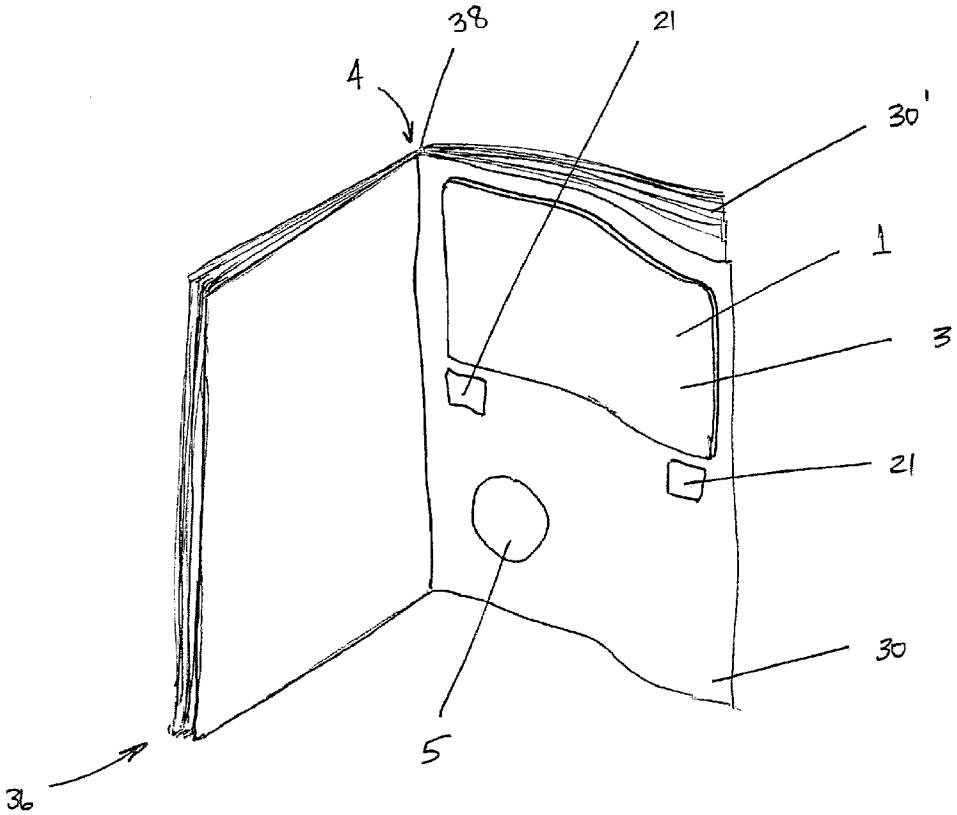
Figure 5:
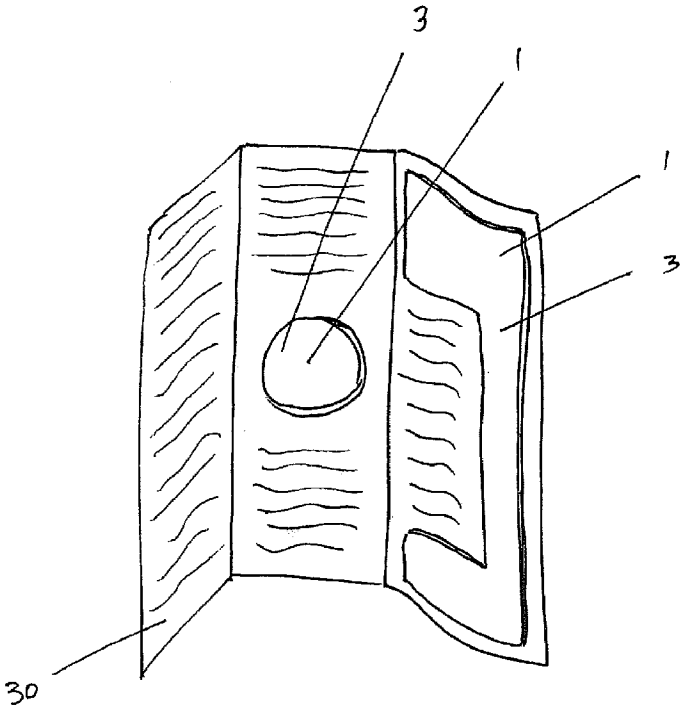
Figure 6:
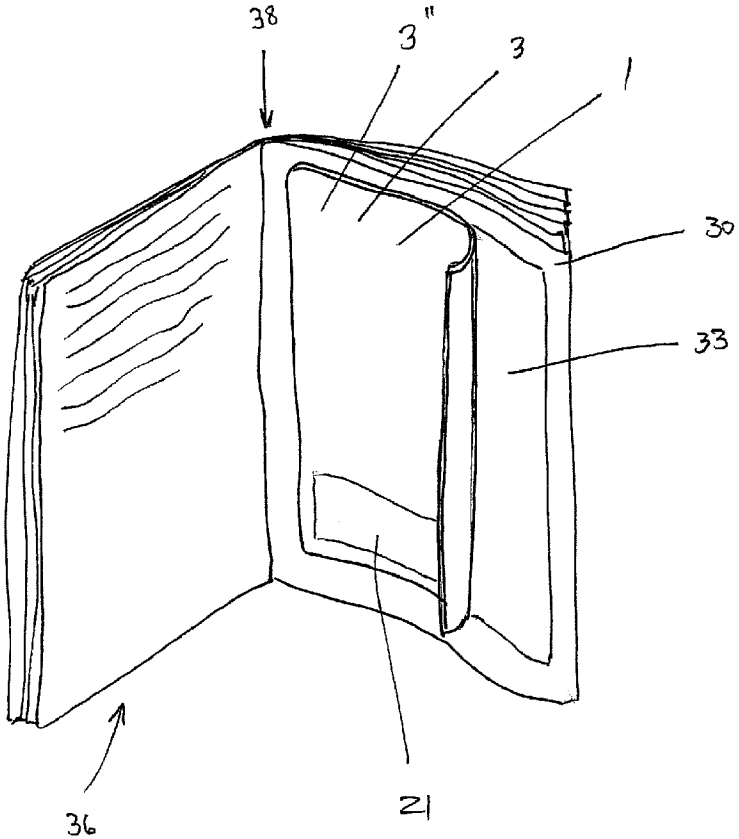
Figure 7:
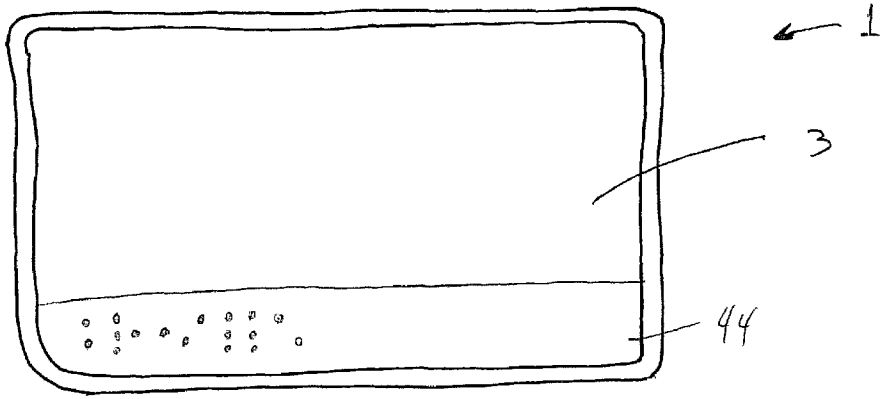
Figure 7A:
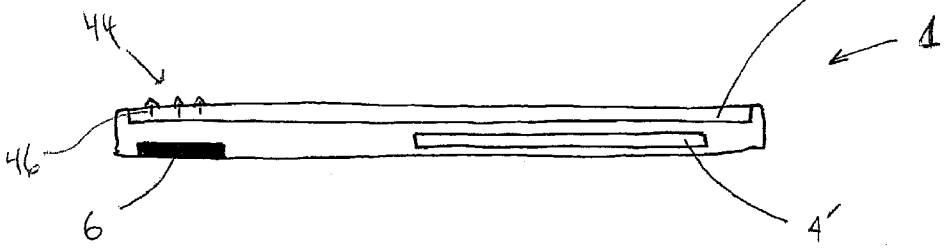

FIG. 4*a* is a perspective view of a periodical or manual having pages bound together and including a flexible electronic display affixed to one of the pages;

FIG. 5 is a perspective view of a flexible page including the flexible electronic display;

FIG. 6 is a perspective view of a flexible page including the removable electronic display;

FIG. 7 is a plan view of an alternate embodiment of the flexible electronic display; and, FIG. 7*a* is side view of FIG. 7.

IV. DESCRIPTION OF THE INVENTION

Figure 1:
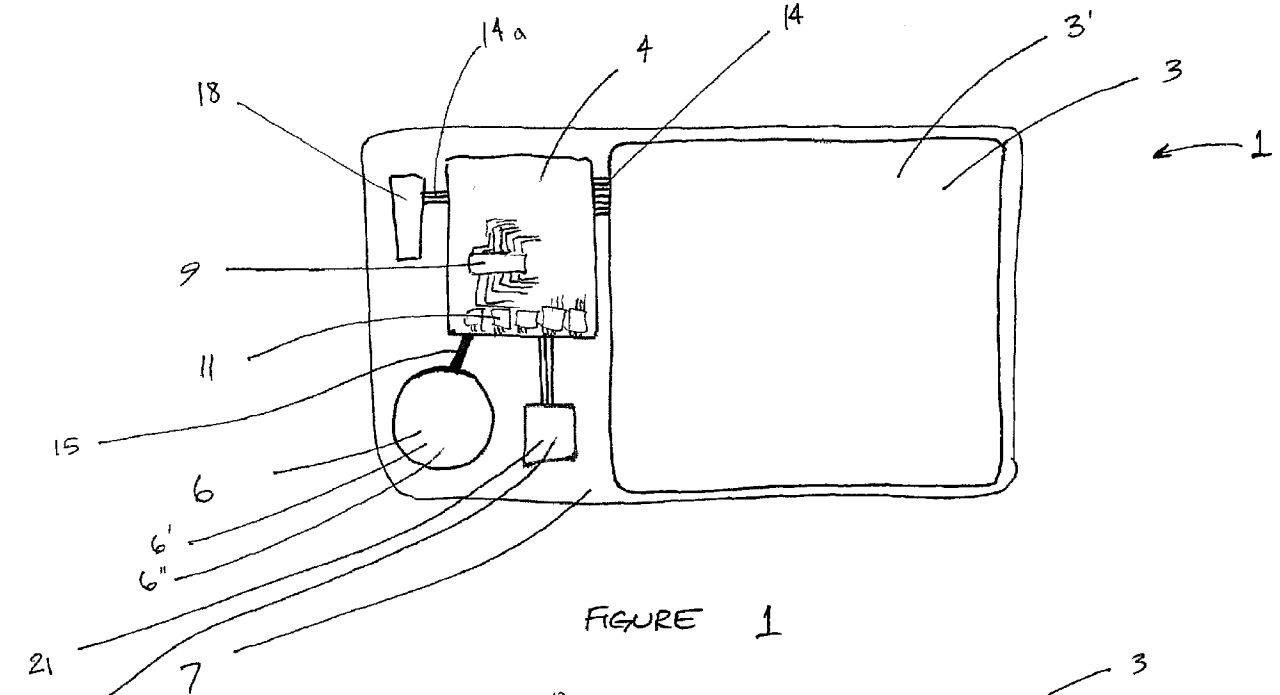

Referring now to the drawings wherein the showings are for purposes of illustrating at least one embodiment of the invention only and not for purposes of limiting the same, FIG. 1 shows a self-contained electronic displaying device shown generally at 1. The self-contained electronic displaying device 1 may include a display portion 3, electronic control circuitry 4 and a power source 6. The device components may be completely contained within the device 1. That is to say that the device components may form a unitary part. In one embodiment, the unitary device may be contained within a flexible sheath 7. Alternately, each of the display components may be individually contained within separate discrete sheaths 7', as will be discussed in detail in a subsequent paragraph. In any embodiment, the display portion 3 may be electrically communicated to the electronic control circuitry 4, which may control how the information is displayed on the display portion 3. Additionally, the power source 6 may be communicated to the control circuitry 4 and/or display portion 3 for use in providing power to operate the device 1. In this way, the electronic displaying device 1 is self-contained in that it does not require a separate power source or external circuitry to display information on the device 1.

Figure 1A:
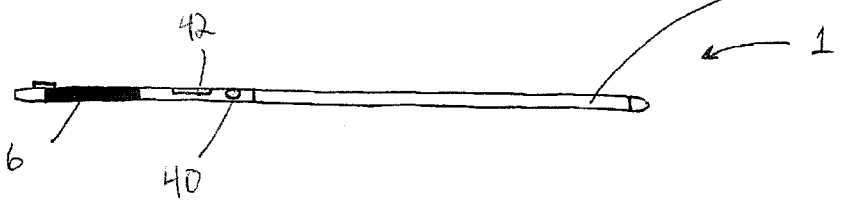

With continued reference to FIG. 1 and now to FIG. 1*a*, the electronic displaying device 1 may be a thin flexible electronic displaying device 1 wherein the electronic displaying device 1 may be resiliently deformable when flexed. That is to say that the self-contained electronic displaying device 1 may be bent back and forth without permanently affecting the displaying characteristics of the self-contained electronic displaying device 1. In this manner, the display portion 3 may also be constructed as a flexible display member 3' wherein information stored in the electronic control circuitry 4 may be selectively depicted on the flexible display member 3'. In one embodiment, the display portion 3 may be an electronic display membrane 3. The display membrane 3 may be thin with respect to the width and length of the electronic display membrane 3. By thin it is generally meant that the thickness of the electronic display membrane 3 may be at least an order of magnitude smaller with respect to the display's width and length. For example, a display membrane having a length of 7 inches or greater may have a thickness of 0.25 inches. It is contemplated in an alternate embodiment that the membrane 3 may have smaller lengths while still having a thickness of 0.25 or smaller. However, any length and/or thickness of membrane 3 may be chosen with sound engineering judgment as is appropriate for use with the subject invention. The electronic display membrane 3 may also be constructed as an optoelectronic device that emits light in the presence of electric current. One such example of the optoelectronic device is an organic light emitting device or OLED. The OLED may be constructed from two or more organic light-emitting material layers fashioned between electrical conductors. When a voltage difference is applied to the conductors, light is emitted from the organic light-emitting material layers, forming a picture element or pixel. Aligning an array of pixels may therefore form a display region or screen. One characteristic of the OLED display screen is that the screen may be flexible and selectively conformed to a curved or contoured surface. In that OLED displays are known in the art, no further explanation will be offered at this time. It is noted that while an OLED display may be used in the subject invention, it is understood that any flexible and substantially thin electronic display may be used without departing from the nature of the subject invention. In another example of an electronic or electrical display membrane 3, the membrane 3 may include individual lights or light emitting means, which may be LEDs that are arranged individually or in an array pattern for displaying information or for attracting attention. In this way, the lighting emitting means may be controlled by the control circuitry 4 and be supplied with power from a power source, as will be discussed further in a subsequent paragraph. However, any light emitting means may be chosen with sound engineering judgment as is appropriate for use with the subject invention.

With continued reference to FIGS. 1 and 1*a*, control circuitry 4 may be communicated to the electronic display membrane 3. The control circuitry 4 may be comprised of a logic processing unit 9 and memory 11. The memory 11 may include dynamic or static memory, one-time programmable or re-programmable memory, fixed or removable memory, or storage means of any type chosen with sound engineering as is appropriate for use with the subject invention. Additionally, the logic processing unit 9 may include a microprocessor and/or any support peripheral circuitry chosen with sound engineering judgment. The control circuitry 4 may similarly be constructed on a thin flexible material by electrically connecting judicially distributed circuit components mounted on said flexible material. Electrical circuits of this type may be constructed on a flexible material (such as polyester) onto which a thin conducting layer (such as copper) has been robustly attached, forming a 'flexible substrate'. Circuit paths may then created by removing unwanted conductor; one means of doing so is by depositing on the conducting layer a masking material in the desired pattern and then exposing the substrate to a chemical that etches away the conductor where there is no masking material. Multilayered substrates may be formed, for example, by layering substrates so constructed, and then electrically connecting the different layers through, for example, drilled holes and the subsequent selective deposition of more conducting material. Circuit components may then be attached in an electrically conductive manner, for example through soldering. Before and/or after components are attached, protective coatings/layers may be applied to the entire assembly. It is also noted that any method of creating a flexible electronic circuit may be chosen with sound engineering judgment. It is also noted that the construction of flexible circuits is well known in the art. Extended from one area of the control circuit may be a communication bus 14 that is connected to electronic display membrane 3. Data from the control circuit memory 11 may be selectively communicated to the display membrane 3 for use in displaying a message on the display membrane 3. The information displayed on the membrane 3 may be one or more static images or dynamic video, or static or dynamic patterns previously stored in the memory 11 prior to activation of the device 1 as will be discussed further in the following paragraphs. Additionally, the membrane 3 may be monochrome or color. Either may be chosen for displaying information as controlled by the control circuitry 4 of the electronic displaying device 1.

With reference again to FIGS. 1 and 1*a*, in one embodiment, the power source 6 or power cell 6 may be substantially thin to be received with the sheath 7 of the device 1. The power source 6 may be a thin battery 6' or a photoelectric cell 6". The battery 6' may be a solid state thin film battery 6' having characteristics similar in size, weight and configuration to paper. Such batteries 6' may be flexible and substantially thin for use in providing power to the subject invention. The batteries 6' may also be rechargeable. In an alternate embodiment, the power source may incorporate a photocell or a solar cell that generates electrical power when exposed to light and/or the sun. In this way, electrical power may be stored and transmitted to the control circuitry 4 and display membrane 3. It is noted that while the power cell 6 may be rechargeable, the power cell 6 is generally a limited capacity power source having a predefined capacity for storing energy. In this manner, the power cell 6 may be a portable power cell 6. It is understood that any type of thin and flexible power source may be chosen with sound engineering judgment including but not limited to combinations of the aforementioned embodiments. The power cell 6 may be communicated to the control circuitry 4 or display portion 3 or any portion of the device 1 via power supply conductors 15 or any means chosen with sound engineering judgment.

With reference once again to FIGS. 1 and 1*a*, the device 1 may include a communication port 18. The communication port 18 may be communicated to the electronic control circuitry 4 via secondary communication bus 14*a* constructed in a manner similar to that as described above. However, any manner of constructing communication buses may be chosen with sound engineering judgment that is appropriate for use with a flexible and thin electronic display device 1. The communication port 18 may be directly connected to the control circuitry for use in reading electronic information from and writing electronic information to one or more portions of the control circuitry 4. In this manner, data comprising the information displayed on the display membrane 3 or data used in controlling how the information is displayed on the display membrane 3 may be read or written in any manner consistent with operation of the subject control circuitry 4. In this way, the communication may be used to program, or reprogram, the control circuitry 4 with different messages or different message displaying schemas.

With reference one again to FIGS. 1 and 1*a*, the electronic displaying device 1 may include a sensor or sensor means 21. The sensor means 21 may comprise a single sensor. However, sensor means 21 may also comprise one or more sensors forming a sensor array 21' functional to sense different conditions surrounding the electronic displaying device 1. In one embodiment, sensor means 21 comprises one type of sensor 21 that may detect the proximity of an object close to the sensor 21. One such object that may be detected by sensor 21 may be a page in a magazine. The sensor may be connected to the control circuitry 4 for use in determining when or how information stored in the control circuitry 4 is displayed on the display membrane 3 as will be discussed further in a subsequent paragraph. The sensor 21 may be connected to the control circuitry 4 in any manner chosen with sound engineering judgment. It is noted that any type, quantity and configuration of sensors may used with the subject invention including but not limited to light sensitive sensors, pressure sensors, proximity sensors, motion sensors and the like. Additionally, any size and shape of sensors may be chosen with sound engineering judgment that is sufficiently thin for use with the electronic displaying device 1. In one embodiment, sensor means 21 may include a touch sensitive display screen 3" or pressure sensitive sensor covering the top face of the display membrane 3 for use as a user interface. In this way, the display membrane 3 may utilize programmable softkeys that function to interact with the user. As shown in FIG. 1*a*, the device 1 can have a headphone jack 40, which enables the user to insert a set of headphone (not shown) into the device 1. In one embodiment of this invention, the device could also have a port 42 for inserting memory, such as a memory stick (not shown). The operation of memory ports are well known in the field, and will not be described further herein.

Figure 2:
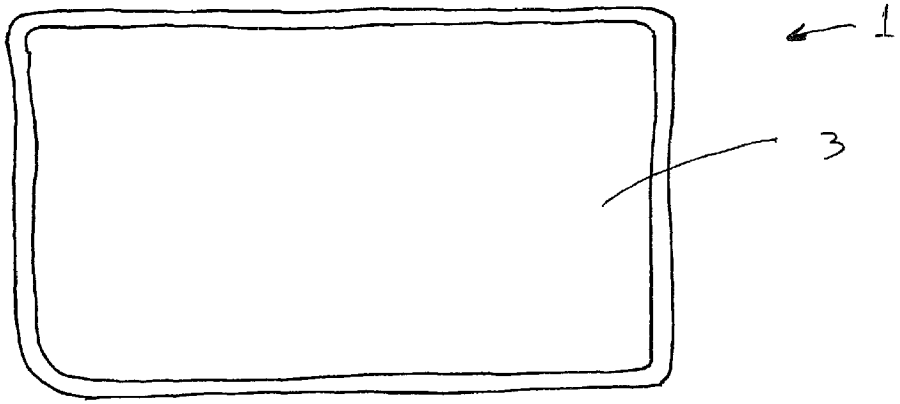
Figure 2A:
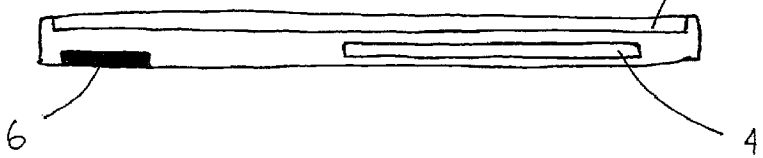
Figure 3:
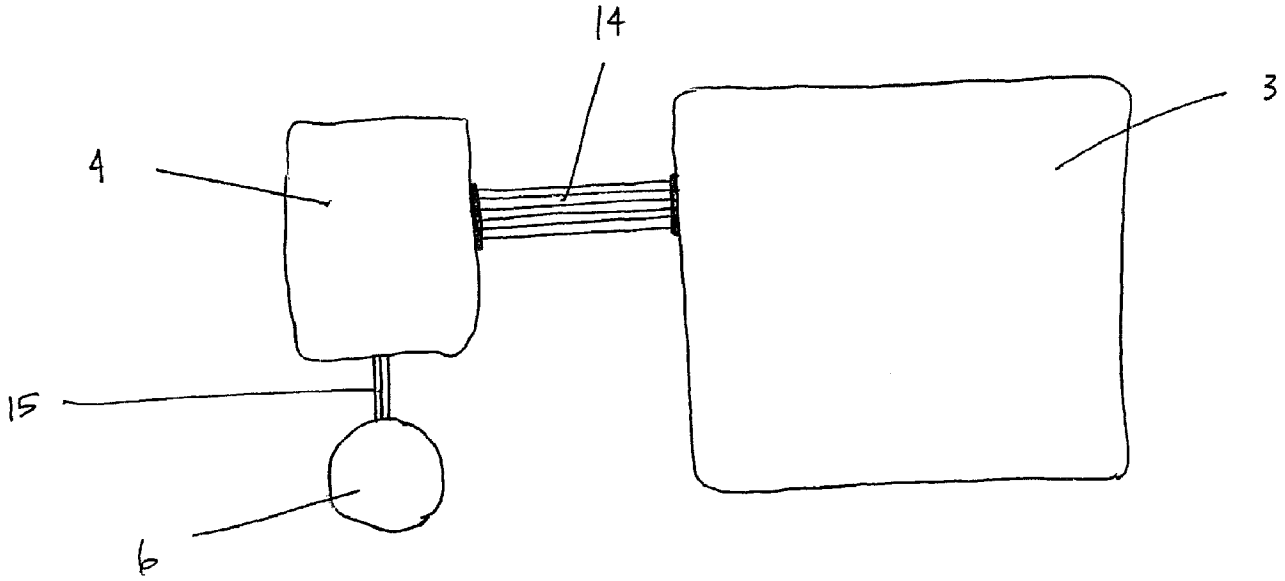
FIG. 3 is a plan view of yet another embodiment of the flexible electronic display.

With reference now to FIGS. 2, 2*a* and 3, alternate embodiments of the electronic displaying device 1 will now be discussed. As previously detailed, FIGS. 1 and 1*a* show the components of the device 1 juxtaposed to each other with respect to a common plane of reference. Alternately, FIGS. 2 and 2*a* show the display membrane 3 disposed in front of the control circuitry 4 and power cell 6. That is to say that the display membrane 3 is positioned in a different reference plane than the control circuitry 4 and power cell 6. In this way, the viewing area, i.e. length versus width, of the display membrane 3 is maximized by placing the remaining components behind the display membrane 3. This allows for a larger viewing display region to be used where the thickness of the display device 1 is not as critical. In this configuration, the display membrane 3, control circuitry 4 and power cell 6 are still contained in a single sheath 7 or unitary package. FIG. 3 shows yet another embodiment of the display device wherein the display membrane 3, control circuitry 4 and power cell 6 are not included in a single sheath 7 but are interconnected only via conductors 14, 15. In this manner, the display membrane 3 may be placed on a desired surface and the remaining components remotely positioned dependent upon the application. For example, the display membrane 3 may be conspicuously positioned on the exterior of a product and the control circuitry 4 and power cell 6 placed interior to the product packaging. However, it is noted that any configuration of the display device 1 and the components included therein may be utilized in a manner consistent with the present invention.

With reference now to FIG. 4 and FIG. 6, a flexible page containing printed information is shown generally at 30. The information on the page 30 may comprise text, including words, symbols, and the like, as well as images or pictures as shown generally at 32. However, any information, images, pictures, etc. and/or combination thereof may be contained on a page 30 as is well known in the art. It is noted at this point that the page 30 may reside within or upon numerous items including but not limited to a magazine or magazine cover, pamphlet or single sheet brochure, instruction manual, instruction sheet, emergency exit display, menu, map/atlas, removable self contained "promotional" insert, informational insert, post card, envelopes, jewel case, folder label, bumper sticker, wallet picture/video display, product assembly instructions, video sports cards, pin-on buttons, products (as product labels, such as soup can labels), and the like. It is understood that magazine may refer to any general booklet type item that has pages contained therein and held together at a central binding, wherein the binding may include any means for holding the pages of the booklet together. Continuing, the electronic displaying device 1 may be affixed to a portion of the page 30. By affixed it is meant that the electronic displaying device 1 may be permanently or remove-ably placed on the page 30 wherein the electronic displaying device 1 is secured to the page via an adhesive or other means. By removably placed it is meant that electronic displaying device 1 may be selectively detached from the page 30 and placed in a different location for continued viewing. For example, the electronic displaying device 1 may be peeled off of the page 30 and placed elsewhere without affecting the self-contained electronic displaying device 1 display capabilities. Alternately, the electronic displaying device 1 may include a magnetic back for placing the electronic displaying device on a magnetically attracting surface for continued display. It is noted that any type of backing may be used on the electronic displaying device for use in remotely placing the device 1 as chosen with sound engineering judgment. This may be accomplished by securing the electronic displaying device 1 to a backing material 33 or by securing the electronic displaying device 1 directly to the page 30. However, it is noted that any means of affixed or securing the electronic displaying device 1 onto the page 30 may be chosen with sound engineering judgment including but not limited to fasteners, clasps, pins and the like. In this manner, the self-contained electronic displaying device 1 may be an integral part of the page 30 for use in dynamically displaying images, video, sound and the like directly on the page 30. That is to say that the page 30 with electronic displaying device 1 is portable and self-contained wherein there is no requirement for an external power supply to supply power to the device and wherein there is no external transmission of display data being sent to the electronic displaying device 1. In this way, the electronic displaying device 1 is self-contained. It is also noted that the membrane 3 may cover any percentage of the page 30 as chosen with sound engineering judgment. In FIG. 4, the membrane 3 is shown to span across the top portion of the page 30. However, in an alternate embodiment, the membrane 3 may be substantially the size of the entire page 30. Although, any size membrane 3 may be chosen with sound engineering judgment.

With reference to FIG. 4*a*, the electronic displaying device 1 is shown affixed to a page 30 wherein the page 30 is one of numerous pages 30' bound together at a binding 38, as in a periodical, magazine or instruction manual 36. In this embodiment, the electronic displaying device 1 may be affixed directly onto the page 30 bound in the periodical 36 or to a backing material 33 and then subsequently affixed to the page 30. Sensor means 21 may be positioned on the page 30 as well for use in determining when the pages 30' are turned with respect to the page 30 containing the electronic displaying device 1. In this manner, when an associated user/viewer of the periodical 36 turns the pages 30' of the periodical 36 to reveal page 30 containing the electronic displaying device 1, the sensor means 21 senses the opened page and may begin displaying the message contents of the electronic displaying device 1. It is noted the placement of the sensor means 21 may be placed anywhere on the page 30 as chosen with sound engineering judgment. The power source 6 and control circuitry 4 may be placed behind the membrane 3 adjacent to the page 30 or may be placed within the binding 38 of the periodical 36 to conceal the power source 6 and control circuitry 4 from the sight of the user/viewer. In an alternate embodiment, an audio transmitting means 5 may also be affixed to the page 30 or may be affixed to the membrane 3. The audio transmitting means 5 may be a speaker 5' or any other audio transmitting device chosen with sound engineering judgment. In this way, the information displayed on the membrane 3 may be accompanied by audio signals controlled by the control circuitry 4 and powered by the power source 6. The audio signals may be preprogrammed to correspond directly to the displaying of information on the membrane 3. It is noted that the any manner, volume, timing, or the like of transmitting audio signals from the audio signal transmitting means 5 may be chosen with sound engineering judgment. It is also noted that the control circuitry 4 may be programmed to transmit audio signals at randomly chosen intervals for use in drawing attention to the periodical 36 if no activity has been sensed for predetermined amount of time. In this way, the electronic displaying device 1 may be preprogrammed to automatically display information on the membrane 3 and transmit audio information as initiated by the user/viewer.

With continued reference to all of the FIGURES and especially to FIG. 5, as previously mentioned, the membrane 3 may be rectangular. The display membrane 3 may also be configured in alternate shapes such as circles, ellipses, squares and the like. Additionally, the display membrane may also be annular in configuration. That is to say that the display membrane 3 may be fashioned into a ring with no center. The display membrane 3 may also have a wedge shaped configuration. In this manner, the membrane may surround or outline part or all of existing information displayed or printed on a page 30 as previously discussed. Alternately, the display membrane 3 may include one or more separate sections communicated together but not formed as a single contiguous display. That is to say that there may be separate display membrane sections 3. It will be appreciated that the aforementioned embodiments are listed by way of example and should not be construed as a limited list of possible display membrane configurations. Rather, any configuration of display membranes 3 may be chosen with sound engineering.

With reference again to all of the FIGURES, an alternate embodiment of the subject invention will now be discussed. The display membrane 3, as previously mentioned, may be a flexible display membrane 3, which is to say that the bending of the membrane 3 does not permanently or appreciably affect the display characteristics of the membrane 3. Alternately, the display membrane 3 may be substantially rigid. That is to say that the membrane 3 itself will retain its shape, without regard to backing material, to which the membrane 3 may be adhered to. Any manner of affixing the rigid membrane to backing material and/or removing the rigid membrane 3 and remotely placing the device 1 for continued viewing may be chosen with sound engineering judgment.

With reference again to all of the FIGURES, operation of the subject invention will now be discussed. The display membrane 3 may be communicated to the control circuitry 4. Separately the power source 6 may be communicated to both of the display membrane 3 and control circuitry 4. It is noted that sensor means and communications may also be connected to the device in a manner consistent with the aforementioned methods. As discussed previously, any configuration and/or communication means may be chosen with sound engineering judgment when connecting together the components of the device 1. Subsequently, the device 1 may be preprogrammed with a display message, which may include pictures, video, audio and the like. It is noted that the display message may be specifically tailored for use with a specific article, for example a magazine page. The device 1 may then be placed onto a backing material and subsequently affixed to the subject article. Alternately, the device 1 may be affixed directly onto the article. It is noted at this point that the power source may be previously charged with power before affixing the device 1 to the subject article. The subject article may then be packaged for normal use as is appropriate for each individual type of article. For example, after the device 1 has been affixed to a page of a magazine, the magazine may then be packaged for shipment to the local sales stand. In an alternate embodiment, the article may be an instruction manual for a purchase item wherein the instruction manual may be packaged within the container or affixed upon the container of the purchased item. Continuing, the article may then be opened by the user wherein the display message of the device 1 may be displayed to the user. It is noted that sensor means may cause the device 1 to display the preprogrammed message automatically. Alternately, the device 1 may be activated by a user interface in a manner consistent with the aforementioned description. The user may then remove the device 1 from the article and place the device 1 in a different location for continued display. Alternately, the device 1 may be preprogrammed to automatically periodically display a preprogrammed message without activation by the sensor means or user interface. That is to say that the control circuitry 4 may be preprogrammed to display a preprogrammed message at predetermined intervals. It is noted that any manner of displaying the preprogrammed message may be chosen with sound engineering judgment.

In another embodiment of this invention, the device 1 has communications capabilities. In one embodiment, the device can communicate with other devices via radio communication, or other means of wireless communication. This enables the device 1 to communicate with other similar devices in the general vicinity. For example, the devices 1 in a store would have means for communicating with each other. The operation of the communication devices within device 1 are well known in the art, and will not be further described herein.

In another embodiment, the device 1 (as shown in FIGS. 7 and 7*a*) has a tactile display 44, which can be Braille, or some other form of information. Either a portion of the display membrane 3 (as shown in FIG. 7) or the entire display membrane 3 is dedicated to the tactile display 44. The tactile display 44 will be either dynamic or static. The tactile display 44 is comprised of multiple contact elements, wherein under each contact element is an electromechanical device 46 that allows the contact element to be raised upon the application of an appropriate electrical signal.

In still another embodiment, the device 1 has a programmable touch interface 4'. In this embodiment, instead of an electrical connector, electrical contact is made to the device 1 through physical contact. In this embodiment, the interface 4' communicates through a wire, via a bit-serial connection, with the necessary protocol to decide which device is communicating when and how. An example of the technology being described herein is the iButton® and 1-Wire® available from Maxim Integrated Products of Sunnyvale, Calif.

In another embodiment of the invention, the device 1 has access to a computer network, which access can be either via a physical connection, or through wireless connection. The wireless connection also allows the device 1 to be connected to other devices, such as a printer, a camera/web cam, speakers, telephones, personal digital assistants, and receive audio transmissions such as radio or satellite radio, etc. In one embodiment, the device 1 could be used to send information directly to a user's PDA. The device 1 can also be used to download information from the global computer network to another device.

In another embodiment of the invention, the device 1 can determine its physical location by accessing a physical location determination system (such as a Global Positioning System or the Galileo system), which can be either via a physical connection, or through wireless connection. Furthermore, the device 1 can relay its position when queried via a suitable mechanism, such as receiving a specific radio signal. This information relay can be either via a physical connection or through a wireless connection.

Several embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

The invention claimed is:

1. A method of selectively displaying electronic information in a magazine, the method comprising:

providing one or more adjacent flexible pages bound together at a binding, at least one of said flexible pages having an electronic image display device affixed thereto, said electronic image display device further comprising:

a flexible electronic image display member;

control circuitry in operative communication with said flexible electronic image display member, said control circuitry further comprising computer executable instructions for selectively electronically displaying information on the flexible electronic image display member; and a power source in operative communication with said control circuitry for use in supplying power to the control circuitry; and selectively displaying at least a first electronic image on the electronic image display device.

2. The method of claim 1, wherein said power source is in operative communication with said flexible electronic image display member for use in supplying power to said flexible electronic image display member.

3. The method of claim 1, said electronic image display device further comprising a sensor for use in determining the proximity of the one or more adjacent flexible pages, the method further comprising the step of:

before selectively displaying at least a first electronic image on the electronic image display device, sensing the proximity of a flexible page adjacent to the electronic image display device.

4. The method of claim 1, said electronic image display device further comprising an electronic information storage means.

5. The method of claim 4, further comprising the step of:

selectively communicating the electronic information storage means to said control circuitry.

6. The method of claim 5, wherein said electronic information storage means is programmed with at least one electronic image.

7. The method of claim 6, further comprising the step of:
reprogramming said electronic information storage means with at least one different electronic image.

8. The method of claim 4, said electronic image display device further comprising a communication port in operative communication with said control circuitry, the method further comprising the step of:
programming the electronic information storage means with at least one electronic image via said communication port.

9. The method of claim 1, wherein said control circuitry is affixed to said binding.

10. The method of claim 1, wherein said control circuitry is affixed to one of said flexible pages.

11. The method of claim 1, wherein the electronic image display device is selectively removably attached to said at least one of said flexible pages, such that the electronic image display device is still capable of displaying the electronic image when removed from said at least one of said flexible pages.

12. The method of claim 11, wherein said electronic image display device is configured for attachment to a surface other than said at least one of said flexible pages, and is further configured to display at least said first electronic image after attachment to said surface.

13. An electronic information displaying apparatus, comprising:
at least one flexible page of a publication;
a thin, flexible electronic image display member;
electronic control circuitry in operative communication with said electronic image display member, said electronic control circuitry further comprising computer executable instructions for selectively electronically displaying information on the flexible electronic image display member; and
a power source in operative communication with said control circuitry for use in supplying power to the electronic control circuitry;
wherein said electronic image display member, said electronic control circuitry, and said power source are affixed to said flexible page.

14. The apparatus of claim 13, wherein said power source is in operative communication with said flexible electronic image display member for use in supplying power to said flexible electronic image display member.

15. The apparatus of claim 13, wherein said image display member is selectively removable from said at least one flexible page.

16. The apparatus of claim 15, wherein said image display member is capable of displaying information after said image display member is removed from said at least one flexible page.

17. The apparatus of claim 16, wherein said electronic image display member is configured for attachment to a surface other than said flexible page, and is further configured to electronically display information after attachment to said surface.

18. The apparatus of claim 13, wherein said control circuitry and said power source are flexible.

19. The apparatus of claim 13, further comprising:
electronic information storage means, said electronic information storage means being selectively removable with respect to the electronic control circuitry.

20. The apparatus of claim 13, further comprising:
a user interface in operative communication with said electronic control circuitry.

21. The apparatus of claim 13, further comprising:
a sensor for use in determining the proximity of at least a first flexible page with respect to at least a second flexible page of said publication.

22. The apparatus of claim 13, further comprising:
an audio transmitting device in operative communication with said electronic control circuitry.

23. The apparatus of claim 22, wherein said electronic control circuitry is programmed to generate audio signals at predetermined intervals.

24. The apparatus of claim 13, wherein said electronic control circuitry is programmed to display information at predetermined intervals.

25. The apparatus of claim 13, further comprising:
at least one sensor capable of detecting the presence of an object within a predetermined proximity of said apparatus.

26. The apparatus of claim 25, wherein said apparatus is configured to display an electronic image or emit a sound dependent upon said at least one sensor detecting the presence of an object within said predetermined proximity of said apparatus.

27. The apparatus of claim 13, wherein said electronic image display member is resiliently deformable without permanently affecting the displaying characteristics of the electronic image display member.

28. The apparatus of claim 13, wherein said electronic image display member is disposed in front of said electronic control circuitry and said power source.

29. The apparatus of claim 13, wherein said electronic image display member further comprises one or more light emitting devices arranged in either a predetermined or random pattern, said light emitting devices being selectively illuminated in a predetermined or random pattern.

30. A method of selectively displaying electronic information on an item having non-electronic information thereon, the method comprising:
providing an electronic image display device affixed to said item, said electronic image display device further comprising:
a flexible electronic image display member;
control circuitry in operative communication with said flexible electronic image display member, said control circuitry further comprising computer executable instructions for selectively electronically displaying information on the flexible electronic image display member; and
a power source in operative communication with said control circuitry for use in supplying power to the control circuitry; and
selectively displaying at least a first electronic image on the electronic image display device.

31. The method of claim 30, wherein said item further comprises a publication and said electronic image display device is attached to a first page of said publication, said electronic image display device further comprising a sensor for use in determining the proximity of a second page of said publication, the method further comprising the step of:
before selectively displaying at least a first electronic image on the electronic image display device, sensing the turning of said second page of said publication.

32. The method of claim 30, said electronic image display device further comprising an electronic information storage means; and
control circuitry in operative communication with said flexible electronic image display member, said control circuitry further comprising computer executable instructions for selectively electronically displaying the information on the flexible electronic image display member.

33. The method of claim 32, further comprising the step of:

selectively communicating the electronic information storage means to said control circuitry.

34. The method of claim 33, wherein said electronic information storage means is programmed with at least one electronic image.

35. The method of claim 34, further comprising the step of:

reprogramming said electronic information storage means with at least one different electronic image.

36. The method of claim 32, said electronic image display device further comprising a communication port in operative communication with said control circuitry, the method further comprising the step of:

programming the electronic information storage means with at least one electronic image via said communication port.

37. The method of claim 30, wherein said item further comprises a publication, and wherein said electronic image display device further comprises control circuitry affixed to a binding of said publication and in operative communication with said flexible electronic image display member.

38. The method of claim 30, wherein said item further comprises a publication, and wherein said electronic image display device further comprises control circuitry affixed to a flexible page of said publication and in operative communication with said flexible electronic image display member.

39. The method of claim 30, wherein the electronic image display device is selectively removably attached to said item, such that the electronic image display device is still capable of displaying the electronic image when removed from said item.

40. An electronic information displaying apparatus, comprising:

an item having non-electronic information thereon;

a thin, flexible electronic image display member;

electronic control circuitry in operative communication with said electronic image display member, said electronic control circuitry further comprising computer executable instructions for selectively electronically displaying information on the flexible electronic image display member; and a power source in operative communication with said control circuitry for use in supplying power to the electronic control circuitry;

wherein said electronic image display member, said electronic control circuitry, and said power source are affixed to said item.

41. The apparatus of claim 40, wherein said image display member is selectively removable from said item.

42. The apparatus of claim 41, wherein said image display member is capable of displaying information after said image display member is removed from said item.

43. The apparatus of claim 42, wherein said image display member is configured for attachment to a surface other than said item, and is further configured to electronically display information after attachment to said surface.

44. The apparatus of claim 40, wherein said control circuitry and said power source are flexible.

45. The apparatus of claim 40, further comprising:

electronic information storage means, said electronic information storage means being selectively removable with respect to the electronic control circuitry.

46. The apparatus of claim 40, further comprising:

a user interface in operative communication with said electronic control circuitry.

47. The apparatus of claim 40, said item further comprising a publication, and said apparatus further comprising:

a sensor for use in determining the proximity of at least a first flexible page of said publication with respect to at least a second flexible page of said publication.

48. The apparatus of claim 40, further comprising:

an audio transmitting device in operative communication with said electronic control circuitry.

49. The apparatus of claim 40, wherein said electronic control circuitry is programmed to display information at predetermined intervals.

50. The apparatus of claim 40, further comprising:

at least one sensor capable of detecting the presence of an object within a predetermined proximity of said apparatus.

51. The apparatus of claim 50, wherein said apparatus is configured to display an electronic image or emit a sound dependent upon said at least one sensor detecting the presence of an object within said predetermined proximity of said apparatus.

52. The apparatus of claim 40, wherein said electronic image display member is resiliently deformable without permanently affecting the displaying characteristics of the electronic image display member.

53. The apparatus of claim 40, wherein said electronic image display member is disposed in front of said electronic control circuitry and said power source.

54. The apparatus of claim 40, wherein said electronic image display member further comprises a plurality of light emitting devices arranged in either a predetermined or random pattern, said electronic control circuitry being further configured to selectively illuminate said light emitting devices in a predetermined or random pattern.

55. A method of selectively displaying electronic information on an article, the method comprising:

providing a flexible electronic image display device affixed to said article, said flexible electronic image display device further comprising:

a plurality of light emitting devices, said flexible electronic image display device being configured to selectively illuminate said light emitting devices so as to display a message to a viewer of said article; and a power source in operative communication with said plurality of light emitting devices; and selectively displaying at least a first electronic image on said plurality of light emitting devices.

56. The method of claim 55, wherein said message comprises one of a plurality of predetermined static images.

57. The method of claim 55, wherein said message comprises dynamic patterns formed by the selective illumination of said light emitting devices.

58. The method of claim 55, wherein said article further comprises a publication and said electronic image display device is attached to a first page of said publication, said electronic image display device further comprising a sensor for use in determining the proximity of a second page of said publication, the method further comprising the step of:

before selectively displaying at least a first electronic image on the electronic image display device, sensing the turning of said second page of said publication.

59. The method of claim 55, said electronic image display device further comprising an electronic information storage means.

60. The method of claim 59, wherein said electronic information storage means if programmed with at least one electronic message.

61. The method of claim 60, further comprising the step of:

reprogramming said electronic information storage means with at least one different electronic image.

62. The method of claim 59, said electronic image display device further comprising a communication port in operative communication with said electronic information storage means, the method further comprising the step of:

programming the electronic information storage means with at least one electronic message via said communication port.

63. The method of claim 55, wherein said article further comprises a publication, and said flexible electronic image display device further comprises control circuitry affixed to a binding of said publication and in operative communication with said light emitting devices.

64. The method of claim 55, wherein said article further comprises a publication, and said flexible electronic image display device further comprises control circuitry affixed to a flexible page of said publication and in operative communication with said light emitting devices.

65. The method of claim 55, wherein the electronic image display device is selectively removably attached to said article, such that the electronic image display device remains capable of displaying the electronic image when removed from said article.

* * * * *